US011397041B2

(12) United States Patent
Kim et al.

(10) Patent No.: US 11,397,041 B2
(45) Date of Patent: Jul. 26, 2022

(54) REFRIGERATOR AND CONTROLLING METHOD THEREOF

(71) Applicant: SAMSUNG ELECTRONICS CO., LTD., Suwon-si (KR)

(72) Inventors: Do-Hyung Kim, Suwon-si (KR); Su-Cheol Yoo, Hwaseong-si (KR); Jung Woo Yoo, Seoul (KR); Kook Jeong Seo, Seoul (KR); Chang-Hern Lee, Suwon-si (KR); Ha-Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 37 days.

(21) Appl. No.: 16/643,118

(22) PCT Filed: Aug. 8, 2018

(86) PCT No.: PCT/KR2018/009027
§ 371 (c)(1),
(2) Date: Feb. 28, 2020

(87) PCT Pub. No.: WO2019/045306
PCT Pub. Date: Mar. 7, 2019

(65) Prior Publication Data

US 2020/0393179 A1 Dec. 17, 2020

(30) Foreign Application Priority Data

Aug. 28, 2017 (KR) ..... 10-2017-0108709

(51) Int. Cl.
*F25D 21/08* (2006.01)
*F25B 13/00* (2006.01)
(Continued)

(52) U.S. Cl.
CPC ..... *F25D 21/08* (2013.01); *F25B 13/00* (2013.01); *F25D 11/022* (2013.01); *F25D 29/005* (2013.01); *F25B 41/20* (2021.01)

(58) Field of Classification Search
CPC ..... F25B 13/00; F25B 41/20; F25B 41/22; F25D 11/022; F25D 29/005; F25D 21/08;
(Continued)

(56) References Cited

U.S. PATENT DOCUMENTS 5,907,955 A * 6/1999 Park ..... F25D 21/006 62/131
6,058,723 A * 5/2000 Kusunoki ..... F25D 21/002 62/156
(Continued)

FOREIGN PATENT DOCUMENTS

JP 2001-336837 12/2001
KR 2001-0060448 7/2001
(Continued)

OTHER PUBLICATIONS

Extended European Search Report dated Sep. 22, 2020 in European Patent Application No. 18849884.4.
(Continued)

*Primary Examiner* — Kun Kai Ma
(74) *Attorney, Agent, or Firm* — Staas & Halsey, LLP

(57) ABSTRACT

A refrigerator and a method for controlling the same. The refrigerator includes a main body; a first storage chamber and a second storage chamber provided in the main body; a first evaporator provided in the first storage chamber, configured to generate cool air; a second evaporator provided in the second storage chamber, configured to generate the cool air; a switching valve configured to supply a refrigerant to at least one of the first evaporator or the second evaporator; and a controller configured to generate a control signal for
(Continued)

controlling the switching valve so that the refrigerant supplied to at least one of the first evaporator or the second evaporator is distributed according to a predetermined reference, and lower the temperature of the first storage chamber and the second storage chamber to a predetermined temperature based on the generated control signal.

15 Claims, 13 Drawing Sheets

(51) Int. Cl.
*F25D 11/02* (2006.01)
*F25D 29/00* (2006.01)
*F25B 41/20* (2021.01)

(58) Field of Classification Search
CPC .... F25D 29/00; F25D 17/045; F25D 2600/06; F25D 2600/02
See application file for complete search history.

(56) References Cited

U.S. PATENT DOCUMENTS

| | | | | |
|---|---|---|---|---|
| 8,104,301 | B2 * | 1/2012 | Kang | F25D 11/022 62/200 |
| 8,459,049 | B2 * | 6/2013 | Li | F25B 41/37 62/113 |
| 2004/0003613 | A1 | 1/2004 | Shin et al. | |
| 2010/0115973 | A1 * | 5/2010 | Kondou | F25B 5/02 62/115 |
| 2016/0153694 | A1 * | 6/2016 | Ko | F25D 17/04 62/186 |
| 2017/0082335 | A1 * | 3/2017 | Jin | B60H 1/3232 |

FOREIGN PATENT DOCUMENTS

| | | |
|---|---|---|
| KR | 10-2004-0022643 | 3/2004 |
| KR | 10-2007-0025255 A | 3/2007 |
| KR | 10-2009-0046241 | 5/2009 |
| KR | 10-2011-0001698 | 1/2011 |
| KR | 10-2013-0037354 | 4/2013 |
| KR | 10-2015-0070907 | 6/2015 |
| KR | 10-2017-0029346 | 3/2017 |
| KR | 10-2017-0072776 | 6/2017 |
| WO | 2004/016999 | 2/2004 |

OTHER PUBLICATIONS

English Translation of WO2004016999, cited as Reference AG in the IDS filed Sep. 14, 2020.
Partial Supplementary European Search Report dated Jun. 16, 2020 in European Patent Application No. 18849884.4.
European Office Action for European Patent Application No. 18849884.4 dated Jun. 30, 2021.
Korean Office Action dated Oct. 20, 2021, for Korean Patent Application No. 10-2017-0108709 (23 pages including translation).
Korean Notice of Allowance dated Apr. 22, 2022 from Korean Patent Application No. 10-2017-0108709.

* cited by examiner

REFRIGERATOR AND CONTROLLING METHOD THEREOF

CROSS-REFERENCE TO RELATED APPLICATIONS

This application is a U.S. National Stage Application which claims the benefit under 35 U.S.C. § 371 of International Patent Application No. PCT/KR2018/009027, filed on Aug. 8, 2018, which claims the priority benefit of Korean Patent Application No. 10-2017-0108709, filed on Aug. 28, 2017 in the Korean Patent and Trademark Office, the disclosures of which are hereby incorporated by reference in their entirety.

TECHNICAL FIELD

Embodiments of the present disclosure relate to a refrigerator and a method for controlling the same, and more particularly, to a technology for preventing an increase in the temperature of a storage chamber due to a defrosting heat generated in a defrosting process and performing efficient refrigeration and freezing operation.

BACKGROUND ART

Generally, a refrigerator includes a storage chamber, and a cool air supply device for supplying cool air to the storage chamber to store food in a fresh state. The temperature of the storage chamber is maintained within a predetermined range needed to store food in the fresh state. The refrigerator may include a freezing chamber that maintains the temperature below a freezing temperature and a refrigerating chamber that maintains the temperature slightly above the freezing temperature.

In recent years, for convenience of use, the refrigerator has been disclosed in which an upper part is provided as the refrigerating chamber and a lower part is provided as the freezing chamber. In addition, the refrigerator has a plurality of divided storage spaces as well as a separate ice making device for making ice cubes in the refrigerating chamber. There is also provided a product such as a kimchi refrigerator in which a refrigeration temperature or the freezing temperature is set to a predetermined value in order to store food such as kimchi in addition to a general refrigerator.

The temperature of the plurality of storage chambers and an ice making chamber may be controlled by the cool air generated from an evaporator, and cooling may be performed efficiently by using the cool air generated from the evaporator.

On the other hand, in order to prevent the deterioration of the cooling performance due to frost of the evaporator after the cooling process, the frost is removed through a defrosting process. In this case, the temperature of the storage chamber increases due to the influence of the heat source used for defrosting the evaporator, causing changes in the quality and taste of the food stored in the storage chamber.

DISCLOSURE

Technical Problem

Therefore, it is an aspect of the present disclosure to provide a refrigerator, which can prevent the temperature of a storage chamber from increasing due to defrosting heat generated in a defrosting process of the refrigerator and perform an efficient refrigeration and freezing operation, and a method for controlling the same.

Technical Solution

In accordance with an aspect of the present disclosure, a refrigerator includes: a main body; a first storage chamber and a second storage chamber provided in the main body; a first evaporator provided in the first storage chamber, configured to generate cool air; a second evaporator provided in the second storage chamber, configured to generate the cool air; a switching valve configured to supply a refrigerant to at least one of the first evaporator and the second evaporator; and a controller configured to generate a control signal for controlling the switching valve so that the refrigerant supplied to at least one of the first evaporator and the second evaporator is distributed according to a predetermined reference, and lowers the temperature of the first storage chamber and the second storage chamber to a predetermined temperature based on the generated control signal.

The refrigerator may further include: a compressor configured to compress the refrigerant to a high pressure, wherein the controller may adjust the number of revolutions of the compressor to a predetermined number of revolutions so that the temperature of the first storage chamber and the second storage chamber are lowered to the predetermined temperature.

The controller may generate the control signal for controlling the opening time of the switching valve so that the time for supplying the refrigerant to the first evaporator according to the predetermined reference is longer than the time for supplying the refrigerant to the second evaporator.

In accordance with another aspect of the present disclosure, a refrigerator includes: a main body; a first storage chamber and a second storage chamber provided in the main body; a first evaporator provided in the first storage chamber, configured to generate cool air; a second evaporator provided in the second storage chamber, configured to generate the cool air; a first blow fan configured to supply the cool air generated by the first evaporator to the first storage chamber; a second blow fan configured to supply the cool air generated by the second evaporator to the second storage chamber; a first defrost heater provided at a lower part of the first evaporator; a second defrost heater provided at a lower part of the second evaporator; and a controller configured to operate the first blow fan for a first reference time and generate a control signal for operating the first defrost heater after the first reference time elapses to remove frost on the surface of the first evaporator, and operate the second blow fan for a second reference time and generate the control signal for operating the second defrost heater after the second reference time elapses to remove the frost on the surface of the second evaporator.

The second reference time may be longer than the first reference time by a predetermined time, and an operating point of the second defrost heater may be delayed by the predetermined time from the operating point of the first defrost heater.

The first blow fan may stop an operation after the elapse of the first reference time, and the second blow fan may stop the operation after the elapse of the second reference time.

The controller may transmit the control signal for controlling the operations of the first defrost heater and the second defrost heater to be stopped at the same time.

In accordance with another aspect of the present disclosure, a refrigerator includes: a main body; a first storage chamber and a second storage chamber provided in the main body; a third storage chamber provided between the first storage chamber and the second storage chamber; a first evaporator provided in the first storage chamber, configured to generate cool air; a second evaporator provided in the second storage chamber, configured to generate the cool air; a switching valve configured to supply a refrigerant to at least one of the first evaporator and the second evaporator; a first blow fan configured to supply the cool air generated by the first evaporator to the first storage chamber; a second blow fan configured to supply the cool air generated by the second evaporator to the second storage chamber; and a controller configured to control the first blow fan to operate from a first operating point to circulate the cool air generated by the first evaporator, and control the second blow fan to operate and stop for a predetermined time from a second operating point to circulate the cool air generated by the second evaporator.

The refrigerator may further include: a first damper configured to allow the cool air generated by the first evaporator to flow into the first storage chamber; and a second damper configured to allow the cool air introduced into the first storage chamber to flow into the third storage chamber.

The controller may control the first damper and the second damper to be closed before the predetermined time elapses from the first operating point and to be opened after the predetermined time elapses from the first operating point.

The controller may control the first blow fan to supply the cool air generated by the first evaporator to the first storage chamber when the first damper and the second damper are opened.

The controller may control the second blow fan to operate after the predetermined time elapses from a stopping point of the second blow fan so that the cool air generated by the second evaporator is supplied to the second storage chamber.

The controller may generate a control signal for controlling the switching valve so that the refrigerant supplied to at least one of the first evaporator and the second evaporator is distributed according to a predetermined reference.

The controller may generate the control signal for controlling the opening time of the switching valve so that the time for supplying the refrigerant to the second evaporator is longer than the time for supplying the refrigerant to the first evaporator according to the predetermined reference.

In accordance with another aspect of the present disclosure, a method for controlling a refrigerator includes: adjusting the number of revolutions of a compressor to a predetermined number of revolutions so that the temperature of a first storage chamber and a second storage chamber provided in a main body of the refrigerator is lowered to a predetermined temperature; generating a control signal for controlling a switching valve so that a refrigerant is supplied to a first evaporator provided in the first storage chamber for generating cool air and the refrigerant is supplied to a second evaporator provided in the second storage chamber for generating the cool air are distributed according to a predetermined reference; and lowering the temperature of the first storage chamber and the second storage chamber to the predetermined temperature based on the generated control signal.

The generating of the control signal for controlling the switching valve may include controlling the opening time of the switching valve so that the time for supplying the refrigerant to the first evaporator is longer than the time for supplying the refrigerant to the second evaporator according to the predetermined reference.

The method may further include: operating a first blow fan for a first reference time; operating a second blow fan for a second reference time; generating a control signal to operate a first defrost heater after the first reference time elapses to remove frost on the surface of the first evaporator; and generating the control signal to operate a second defrost heater after the second reference time elapses to remove the frost on the surface of the second evaporator.

The second reference time may be longer than the first reference time by a predetermined time, and an operating point of the second defrost heater may be delayed by the predetermined time from the operating point of the first defrost heater.

The first blow fan may stop an operation after the elapse of the first reference time, and the second blow fan may stop the operation after the elapse of the second reference time.

The method may further include: controlling the operations of the first defrost heater and the second defrost heater to be stopped at the same time.

In accordance with another aspect of the present disclosure, a method for controlling a refrigerator includes: controlling a first blow fan to operate from a first operating point to circulate cool air generated by a first evaporator; controlling a second blow fan to operate and stop for a predetermined time from a second operating point to circulate the cool air generated by a second evaporator; and controlling a first damper for allowing the cool air generated by the first evaporator to flow into a first storage chamber and a second damper for allowing the cool air introduced into the first storage chamber to flow into a third storage chamber to be opened after the predetermined time elapses from the first operating point.

The method may further include: controlling the first damper and the second damper to be closed before the predetermined time elapses from the first operating point.

The method may further include: controlling the first blow fan to supply the cool air generated by the first evaporator to the first storage chamber when the first damper and the second damper are opened.

The method may further include: controlling the second blow fan to operate after the predetermined time elapses from the stopping point of the second blow fan so that the cool air generated by the second evaporator is supplied to a second storage chamber.

The method may further include: generating a control signal for controlling a switching valve so that the refrigerant supplied to at least one of the first evaporator and the second evaporator is distributed according to a predetermined reference.

The generating of the control signal for controlling the switching valve may include controlling the opening time of the switching valve so that the time for supplying the refrigerant to the first evaporator is longer than the time for supplying the refrigerant to the second evaporator according to the predetermined reference.

Advantageous Effects

As is apparent from the above description, the refrigerator and the method for controlling the same according to the embodiments of the present disclosure can prevent the quality and taste of the food stored in the storage chamber from being changed due to the temperature increase of the storage chamber by the defrosting heat generated during the defrosting process. In addition, the defrosting heat can be prevented from entering the storage chamber by changing the control algorithm for the existing configuration without adding a separate configuration of the refrigerator.

DESCRIPTION OF DRAWINGS

These and/or other aspects of the disclosure will become apparent and more readily appreciated from the following description of the embodiments, taken in conjunction with the accompanying drawings of which.

MODE FOR INVENTION

Figure 1:
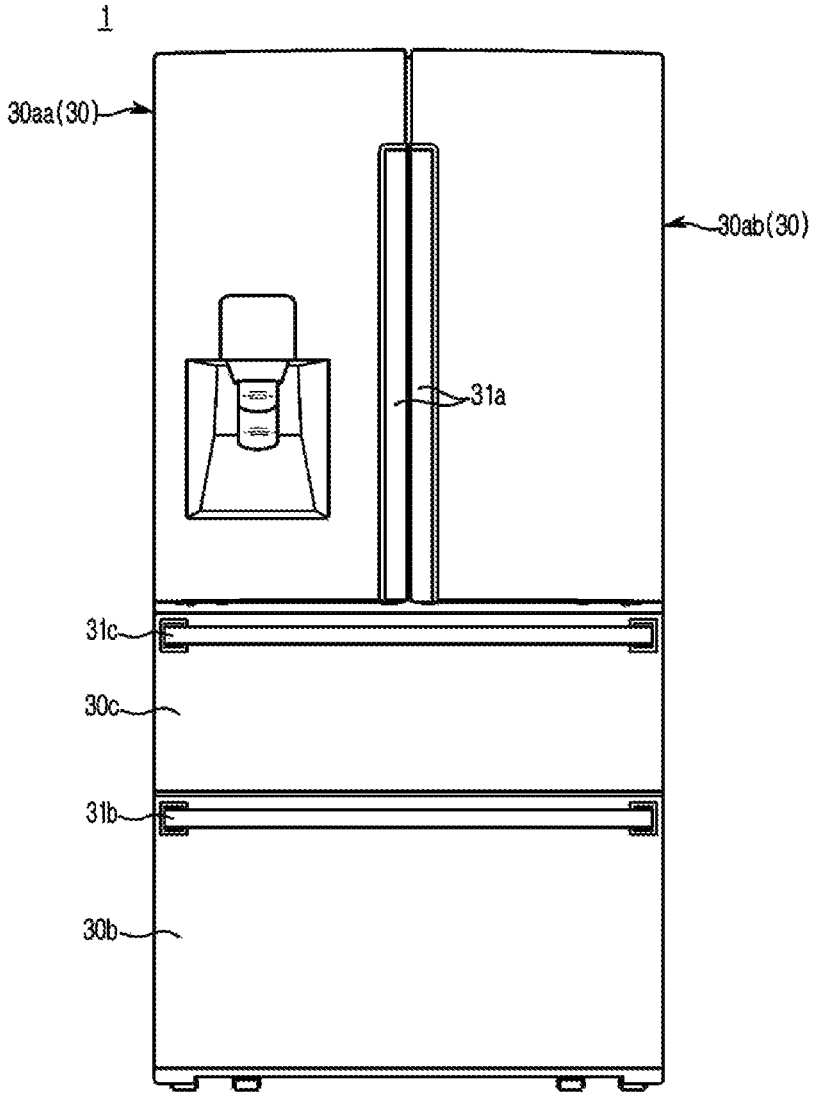
FIG. 1 is a front view illustrating an appearance of a refrigerator according to an embodiment of the present disclosure.

Like numerals refer to like elements throughout the specification. Not all elements of the embodiments of the present disclosure will be described, and the description of what are commonly known in the art or what overlaps each other in the embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are merely used for convenience of explanation, but not to limit an order of the steps. Thus, unless the context clearly dictates otherwise, the written order may be practiced otherwise.

The principle and exemplary embodiments of the present disclosure will now be described with reference to the accompanying drawings.

A refrigerator described in the embodiments of the present disclosure may include various types of refrigerators such as a general refrigerator having a refrigerating chamber and a freezing chamber, and a kimchi refrigerator having a refrigeration temperature or a freezing temperature set to a predetermined value in order to mainly store foods such as kimchi. Thus, the embodiments of the disclosed disclosure may be applied to all types of refrigerators.

In the case of the kimchi refrigerator, a storage chamber for storing foods may be set at a temperature suitable for refrigeration or at a temperature suitable for freezing. In addition, the temperature of the storage chamber may be set as a boundary value between the freezing storage temperature and the refrigerating storage temperature for freshly storing aged food such as kimchi.

Figure 2:
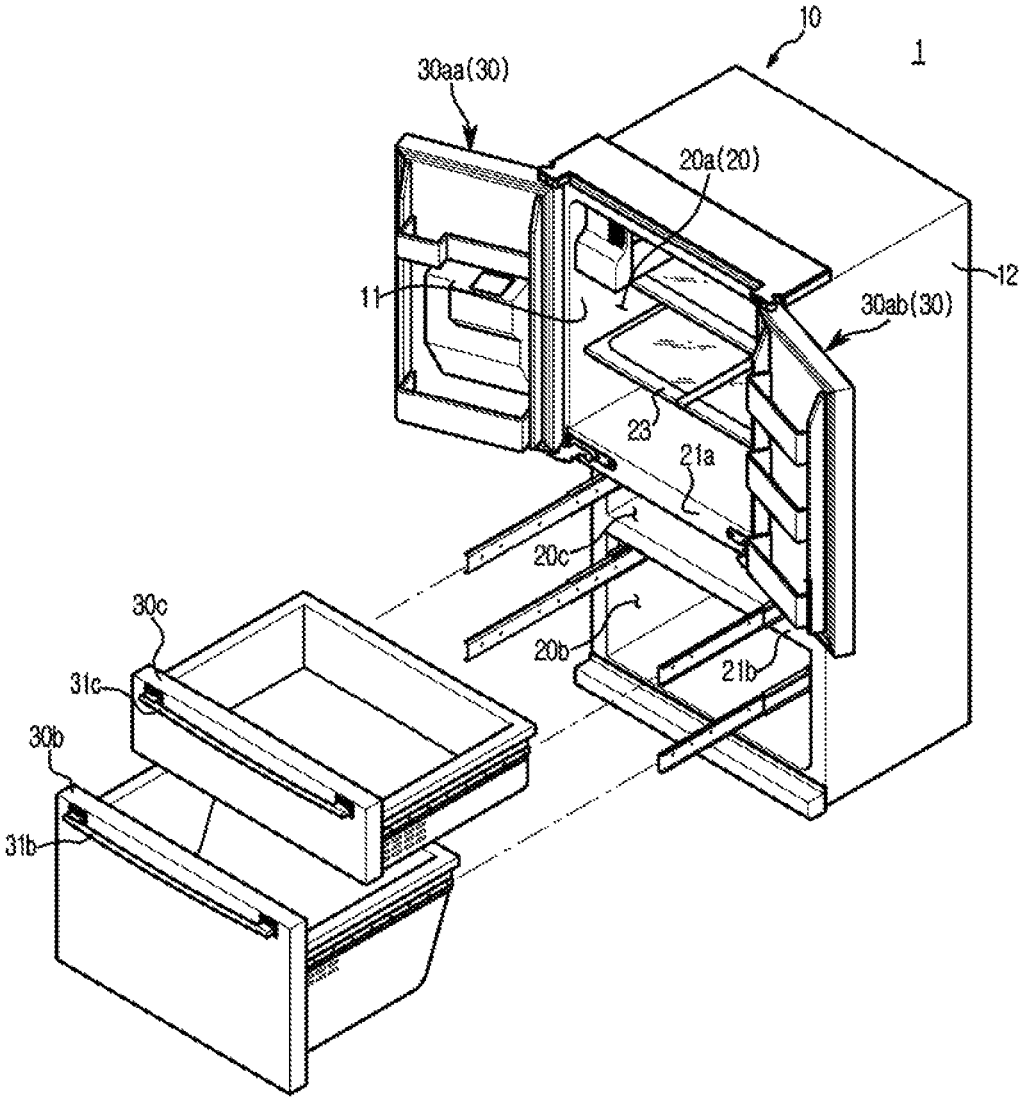
FIG. 2 is a perspective view schematically illustrating a structure of the refrigerator according to an embodiment of the present disclosure.
Figure 3:
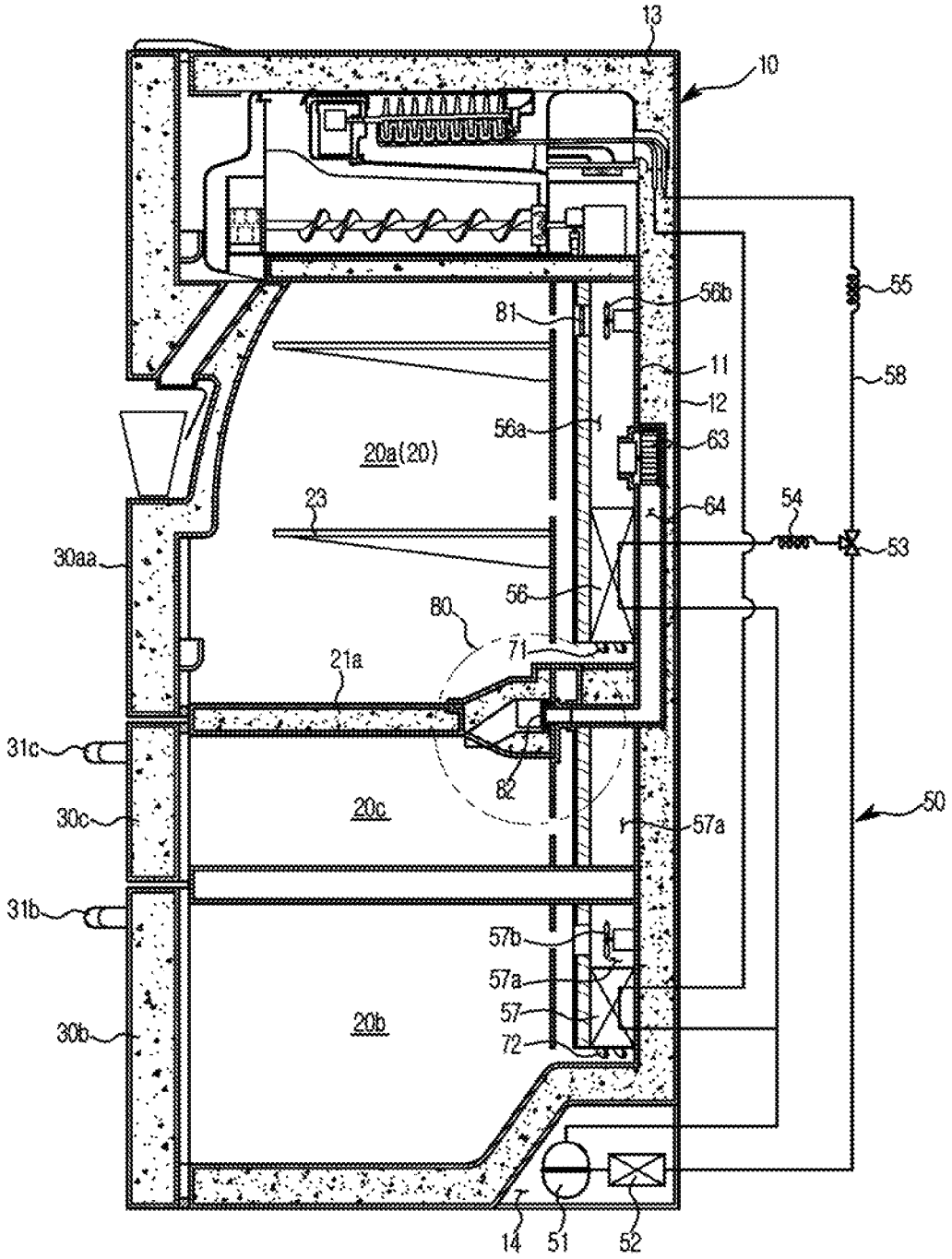
FIG. 3 is a side vertical-sectional view illustrating the refrigerator according to an embodiment of the present disclosure.

FIG. 1 is a front view illustrating an appearance of a refrigerator according to an embodiment of the present disclosure. FIG. 2 is a perspective view schematically illustrating a structure of the refrigerator according to an embodiment of the present disclosure. FIG. 3 is a side vertical-sectional view illustrating the refrigerator according to an embodiment of the present disclosure.

Referring to FIGS. 1 to 3, a refrigerator 1 may include a main body 10 whose front surface opens, a storage chamber 20 formed in the inside of the main body 10 and configured to refrigerate and/or freeze food, a door 30 configured to open or close the opened front surface of the main body 10, and a cooling device 50 configured to freeze the storage chamber 20.

The main body 10 may form an appearance of the refrigerator 1. The main body 10 may include an inner casing 11 to form the storage chamber 20, and an outer casing 12 coupled to an exterior of the inner casing 11. An insulator 13 may be foamed between the inner casing 11 and the outer casing 12 of the main body 10 so as to prevent leakage of cool air from the storage chamber 20.

The storage chamber 20 may be divided into a plurality of chambers. In the refrigerator 1 according to an embodiment of the present disclosure, a first storage chamber 20*a*, a second storage chamber 20*b*, and a third storage chamber 20*c* may form independent storage spaces. At this time, the first storage chamber 20*a* may be referred to as an upper storage chamber, the second storage chamber 20*b* may be referred to as a lower storage chamber, and the third storage chamber 20*c* may be referred to as an intermediate storage chamber located between the first storage chamber 20*a* and the second storage chamber 20*b*, but this can be designed and modified as needed.

In addition, a storage temperature of each of the storage chambers 20 may be independently controlled according to the amount of cool air supplied to each of the storage chambers 20.

The storage chamber 20 may be divided into a plurality of chambers by horizontal partitions 21*a* and 21*b*. For example, as shown in FIG. 2, the first storage chamber 20 may be classified into the first storage chamber 20*a* and the second storage chamber 20*b* by the horizontal partitions 21*a*. The storage chamber 20 may be classified into the second storage chamber 20*b* and the third storage chamber 20*c* by the horizontal partitions 21*b*.

The first storage chamber 20*a* and the third storage chamber 20*c* may refrigerate food, and the second storage chamber 20*b* may freeze food. In the inside of the storage chamber 20, one or more shelves 23 may be provided to put food thereon.

The number and arrangement of the storage chamber 20 are not limited to the embodiment shown in FIG. 2.

The storage chamber 20 may be opened or closed by the door 30. For example, as shown in FIG. 2, the first storage chamber 20*a* may be opened or closed by a first upper door 30*aa* and a second upper door 30*ab*. The first upper door 30*aa* and the second upper door 30*ab* are rotary doors that are rotatably coupled to the main body 10 to open and close the first storage chamber 20*a*.

The second and third storage chambers 20*b* and 20*c* may be opened and closed by drawer doors 30*b* and 30*c* which are slidably coupled to the main body 10.

A handle 31 may be provided on the door 30 to enable a user to easily open or close the door 30. A handle 31*a* may be extended longitudinally along and between the first upper door 30*aa* and the second upper door 30*ab*, and handles 31*b* and 31*c* may be horizontally formed in the drawer doors 30*b* and 30*c*. As a result, when the door 30 is closed, the handle 31 may look as if it is one body with the door 30.

The number and arrangement of the door 30 are not limited to the embodiment shown in FIG. 2.

The cooling device 50 may include, as shown in FIG. 3, a compressor 51 to compress refrigerants to a high pressure, a condenser 52 to condense the compressed refrigerants, expanders 54 and 55 to expand the refrigerants to a low pressure, evaporators 56 and 57 to evaporate the refrigerants, and a refrigerant pipe 58 to guide the refrigerants.

The compressor 51 and the condenser 52 may be provided in a machine room 14 provided in rear lower space of the main body 10.

The evaporators 56 and 57 may include the first evaporator 56 to supply the cool air to the first storage chamber 20*a*, and the second evaporator 57 to supply the cool air to the second storage chamber 20*b*. The first evaporator 56 may be disposed in a first cool air duct 56*a* formed in a rear space of the first storage chamber 20*a*, and the second evaporator 57 may be disposed in a second cool air duct 57*a* formed in a rear space of the second storage chamber 20*b*.

In the first cool air duct 56*a*, a first blow fan 56*a* may be disposed to supply the cool air generated by the first evaporator 56 to the first storage chamber 20*a*, and in the second cool air duct 57*a*, a second blow fan 57*b* may be disposed to supply the cool air generated by the second evaporator 57 to the second storage chamber 20*b*.

The refrigerant pipe 58 may guide refrigerants compressed by the compressor 51 to the first evaporator 56 and the second evaporator 57. In the refrigerant pipe 58, a switching valve 53 may be provided to distribute refrigerants to the first evaporator 56 or the second evaporator 57.

A third cool air duct 64 for communicating with the first evaporator 56 side and the third storage chamber 20*c* side may be provided between the inner casing 11 and the outer casing 12 on the rear side of the main body 10 for circulating the cool air in the third storage chamber 20*c*.

The supply of the cool air to the third cool air duct 64 side may be performed by a circulation fan 63 disposed at a position close to the first evaporator 56. That is, the cool air generated from the first evaporator 56 may be supplied to the third storage chamber 20*c* through the third cool air duct 64 by the circulation fan 63. At this time, the cool air supplied through the third cool air duct 64 may be supplied to the third storage chamber 20*c* through a cool air supply device 80 provided on the rear side of the horizontal partition 21*a*.

A second damper 82 protruding from the lower surface of the horizontal partition 21*a* and communicating with the cool air supply device 80 may be provided in a lower rear side of the horizontal partition 21*a* so that the cool air supplied by the cool air supply device 80 can be discharged to the third storage chamber 20*c*.

When the second damper 82 is closed, the cool air supplied through the third cool air duct 64 may not be supplied to the third storage chamber 20*c*. When the second damper 82 is opened, the cool air may be supplied to the third storage chamber 20*c*. The second damper 82 may control the amount of cool air supplied to the third storage chamber 20*c*.

The cool air generated by the first evaporator 56 may be supplied to the first storage chamber 20*a* through a first blow fan 56*b*. At this time, a first damper 81 that communicates with a passage connecting the first cool air duct 56*a* and the first storage chamber 20*a* may be provided.

When the first damper 81 is opened, the cool air supplied through the first cool air duct 56*a* may be supplied to the first storage chamber 20*a*. When the first damper 81 is closed, the cool air supplied through the first cool air duct 56*a* may not be supplied to the first storage chamber 20*a*. The cool air that has been cooled in the first storage chamber 20*a* may be returned to the first evaporator 56 through an inlet (not shown) provided in the lower rear wall of the first storage chamber 20*a*. The first damper 81 may control the amount of cool air supplied to the first storage chamber 20*a*.

That is, the cool air generated from the first evaporator 56 may be introduced into the first storage chamber 20*a* through the first damper 81 opened through the first cool air duct 56*a*, and the first storage chamber 20*a* may be cooled. The cool air generated from the first evaporator 56 may be introduced into the third storage chamber 20*c* through the second damper 82 opened by the circulation fan 63 through the third cool air duct 64, and the third storage chamber 20*c* may be cooled.

The cool air generated by the second evaporator 57 may be supplied to the second storage chamber 20*b* through the second blow fan 57*b*. That is, the cool air generated by the second evaporator 57 may be introduced into the second storage chamber 20*b* through an outlet (not shown) provided between the second cool air duct 57*a* and the second storage chamber 20*b*. The cool air that has been cooled in the second storage chamber 20*b* may be returned to the second evaporator 57 through an inlet (not shown) provided in the lower rear wall of the second storage chamber 20*b*.

A first defrost heater 71 may be provided in a lower of the first evaporator 56. When freezing occurs or frost is generated in the outlet (not shown) provided in the first cool air duct 56*a*, the first damper 81 or the first evaporator 56 and the cool air generated in the first evaporator 56 is prevented from being discharged to the first storage chamber 20*a*, the first defrost heater 71 may be operated so that the cool air can be smoothly discharged into the first storage chamber 20*a* by stopping the freezing or removing the generated frost.

When the first defrost heater 71 is operated, the air heated by the first defrost heater 71 may be raised by natural convection and may be guided to the first damper 81 or the outlet (not shown) through the first cool air duct 56*a*. Since the air convection in the first cool air duct 56*a* maintains a high temperature, the freezing may be stopped or the frost generated in the first evaporator 56, the first damper 81, or the outlet (not shown) may be removed by the air having the high temperature, and the cool air may be smoothly supplied to the first storage chamber 20*a*.

A second defrost heater 72 may be provided in a lower of the second evaporator 57. When freezing occurs or frost is generated in the outlet (not shown) provided in the second cool air duct 57*a* or the second evaporator 57 and the cool air generated in the second evaporator 57 is prevented from being discharged to the second storage chamber 20*b*, the second defrost heater 72 may be operated so that the cool air can be smoothly discharged into the second storage chamber 20*b* by stopping the freezing or the generated frost.

When the second defrost heater 72 is operated, the air heated by the second defrost heater 72 may be raised by natural convection and may be guided to the outlet (not shown) through the second cool air duct 57*a*. Since the air convection in the second cool air duct 57*a* maintains the high temperature, the freezing may be stopped or the frost generated in the second evaporator 57 or the outlet (not shown) may be removed by the air having the high temperature, and the cool air may be smoothly supplied to the second storage chamber 20*b*.

Figure 4:
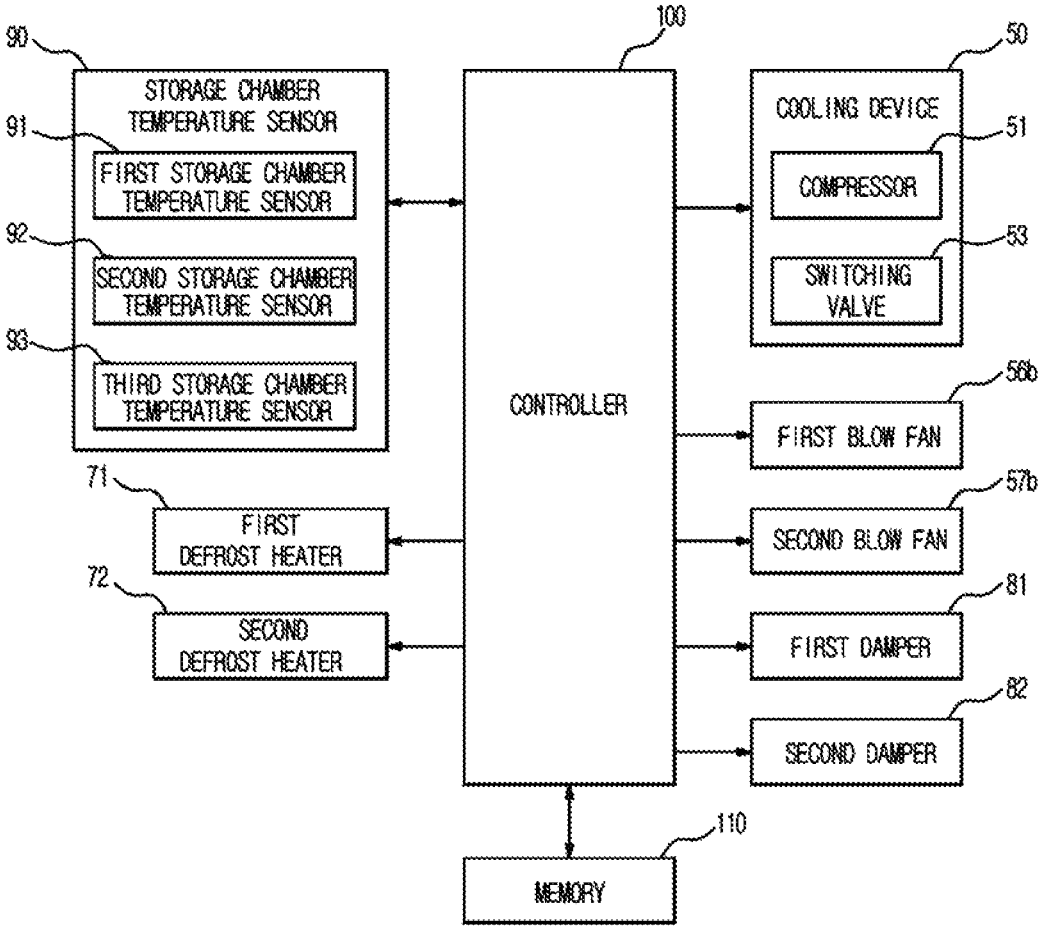
FIG. 4 is a block diagram illustrating the refrigerator according to an embodiment of the present disclosure.
Figure 5:
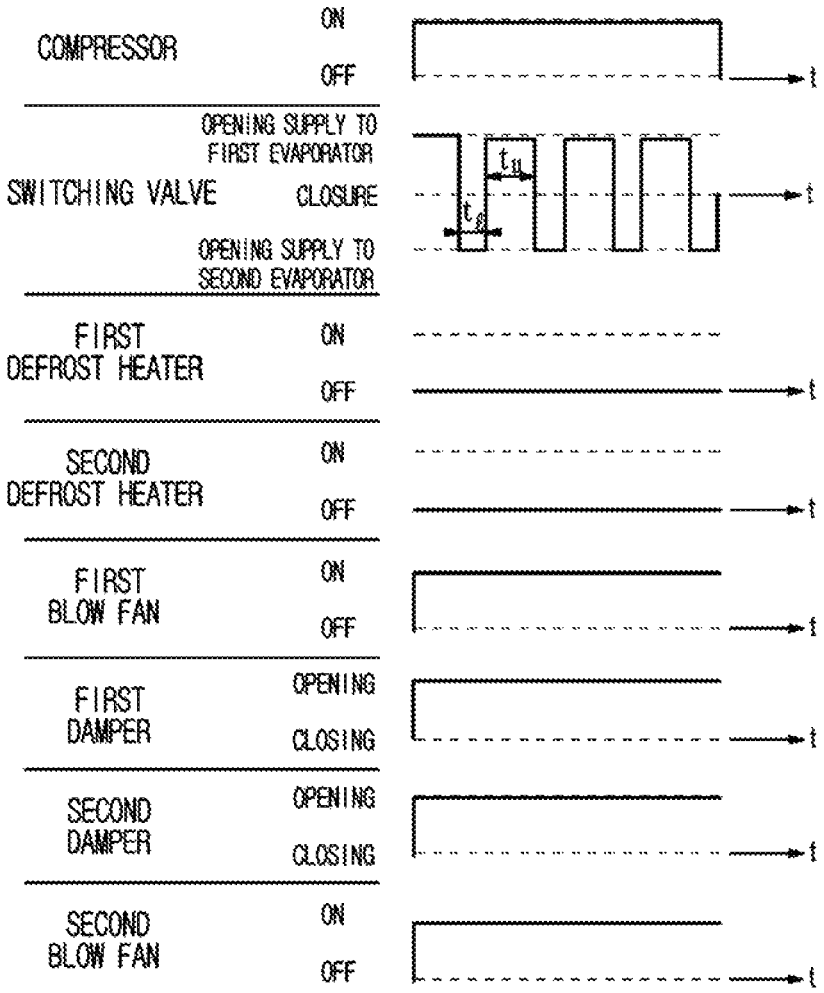
FIG. 5 is a control graph of a cooling section before a defrosting operation of the refrigerator according to an embodiment of the present disclosure.
Figure 6:
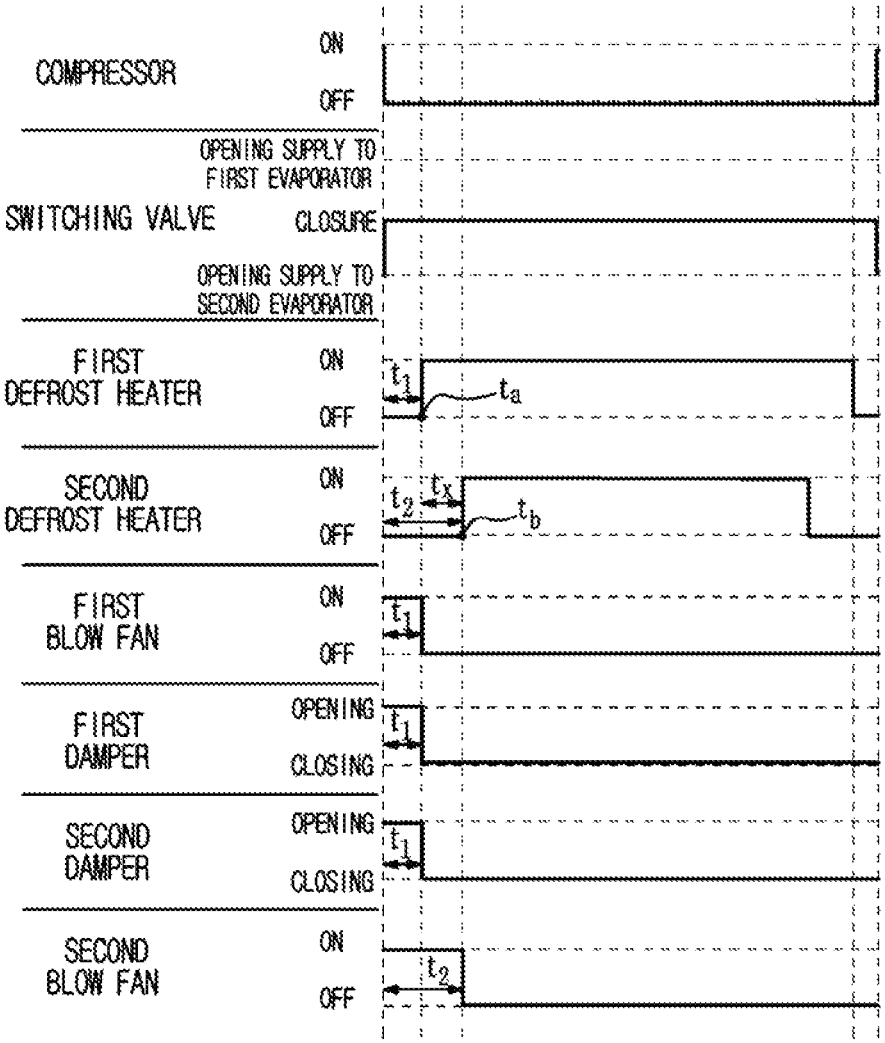
FIG. 6 is a control graph of a defrosting section of the refrigerator according to an embodiment of the present disclosure.
Figure 7:
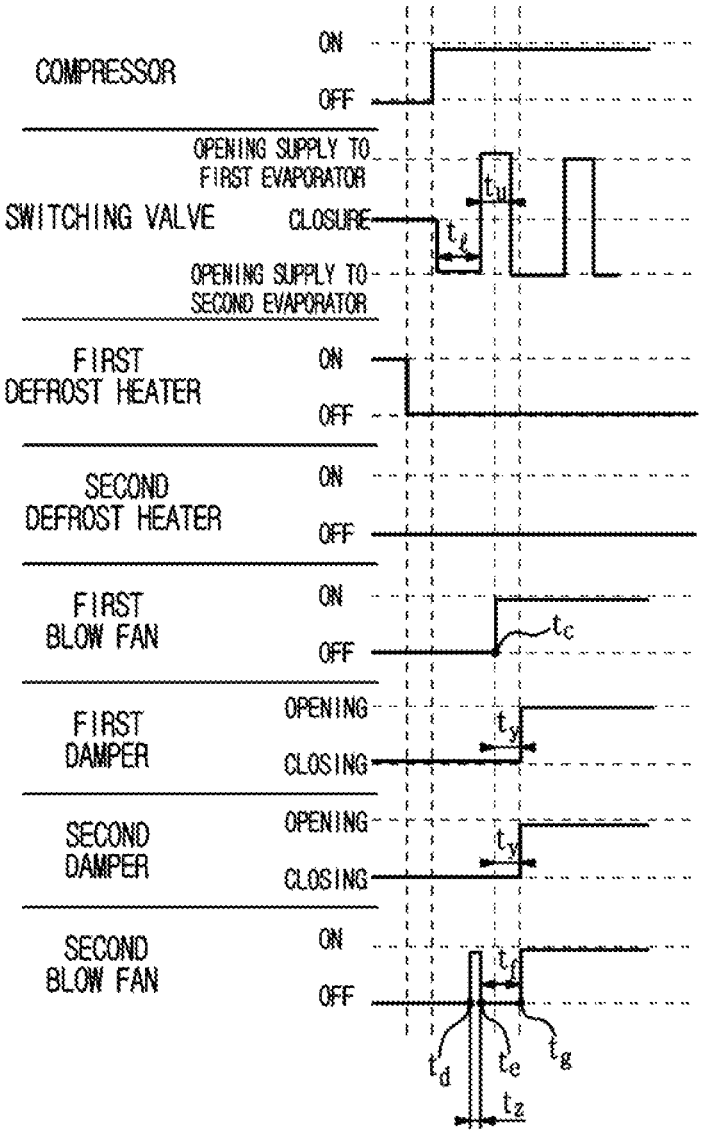
FIG. 7 is a control graph of the cooling section after the defrosting operation of the refrigerator according to an embodiment of the present disclosure.
Figure 8:
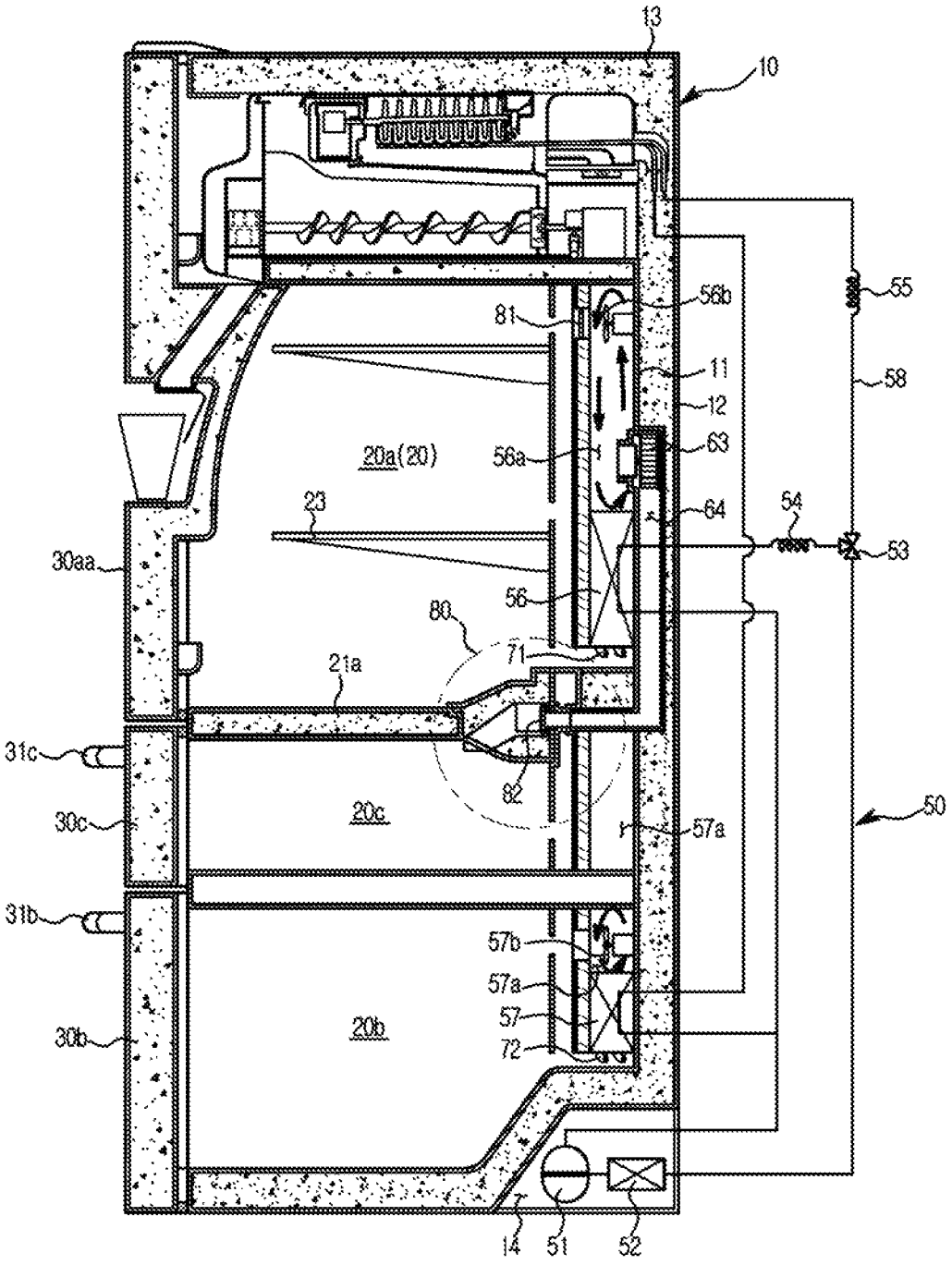
FIG. 8 is a view illustrating a flow of cool air when a first damper and a second damper are closed according to an embodiment of the present disclosure.
Figure 9:
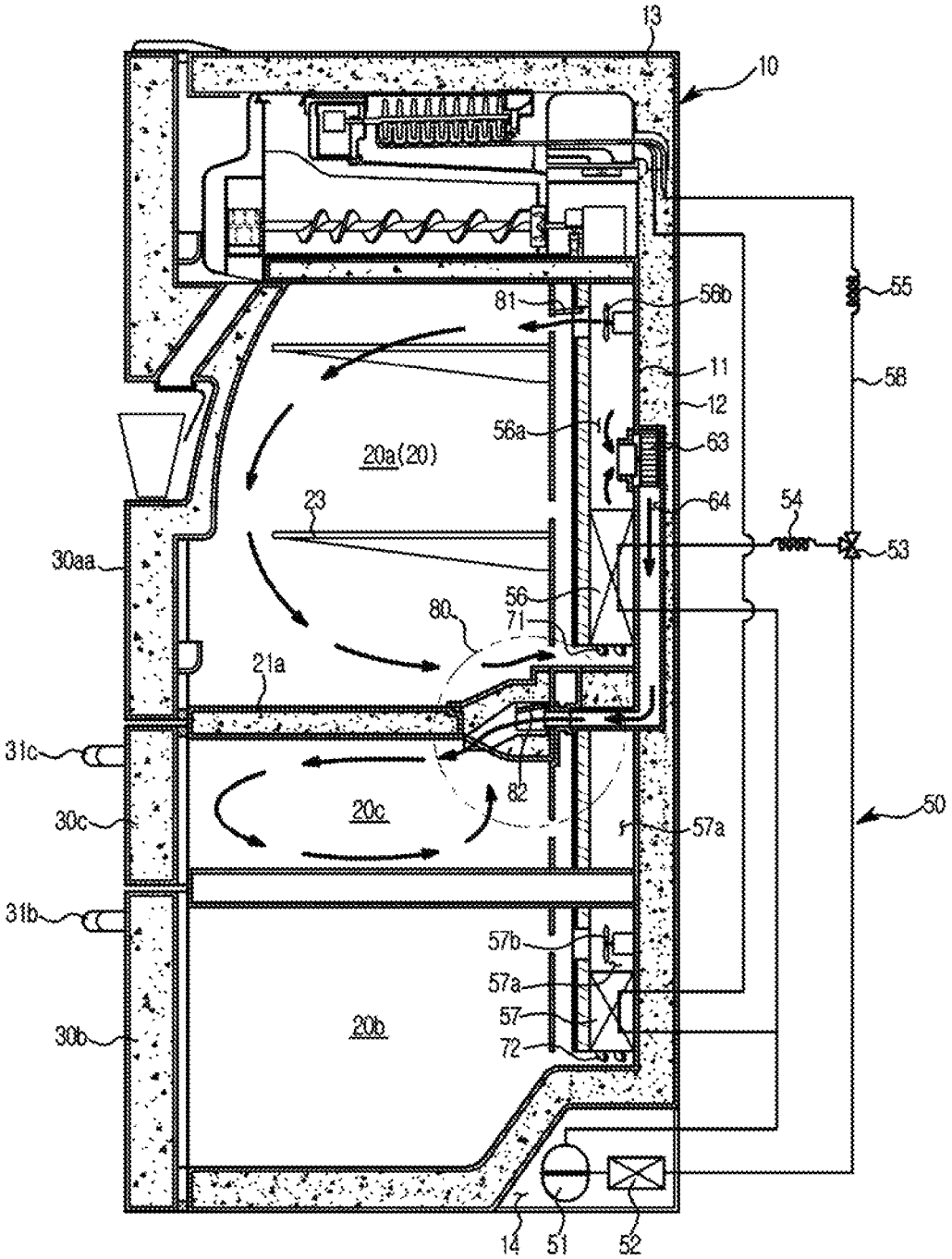
FIG. 9 is a view illustrating the flow of cool air when the first damper and the second damper are opened according to an embodiment of the present disclosure.
Figure 10:
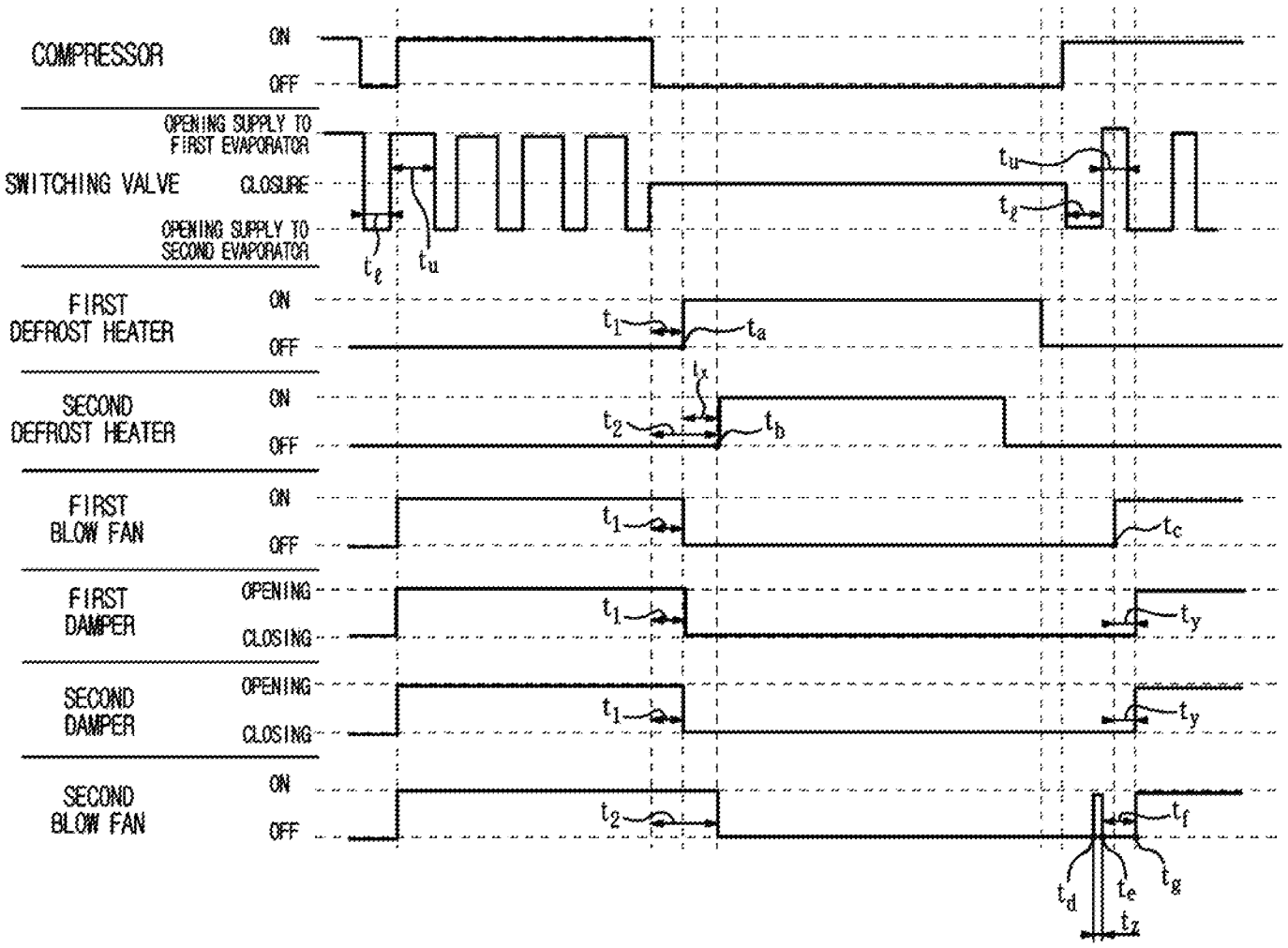
FIG. 10 is a control graph of the entirety of a control section of the refrigerator according to an embodiment of the present disclosure.
Figure 11:
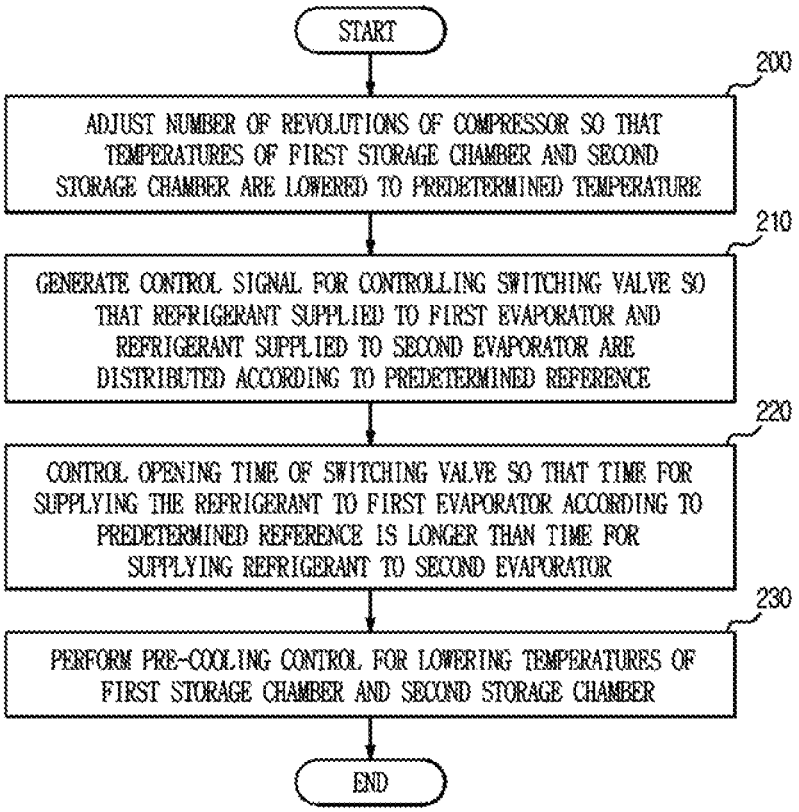
FIGS. 11 to 13 are flowcharts illustrating a method for controlling the refrigerator according to an embodiment of the present disclosure.
Figure 12:
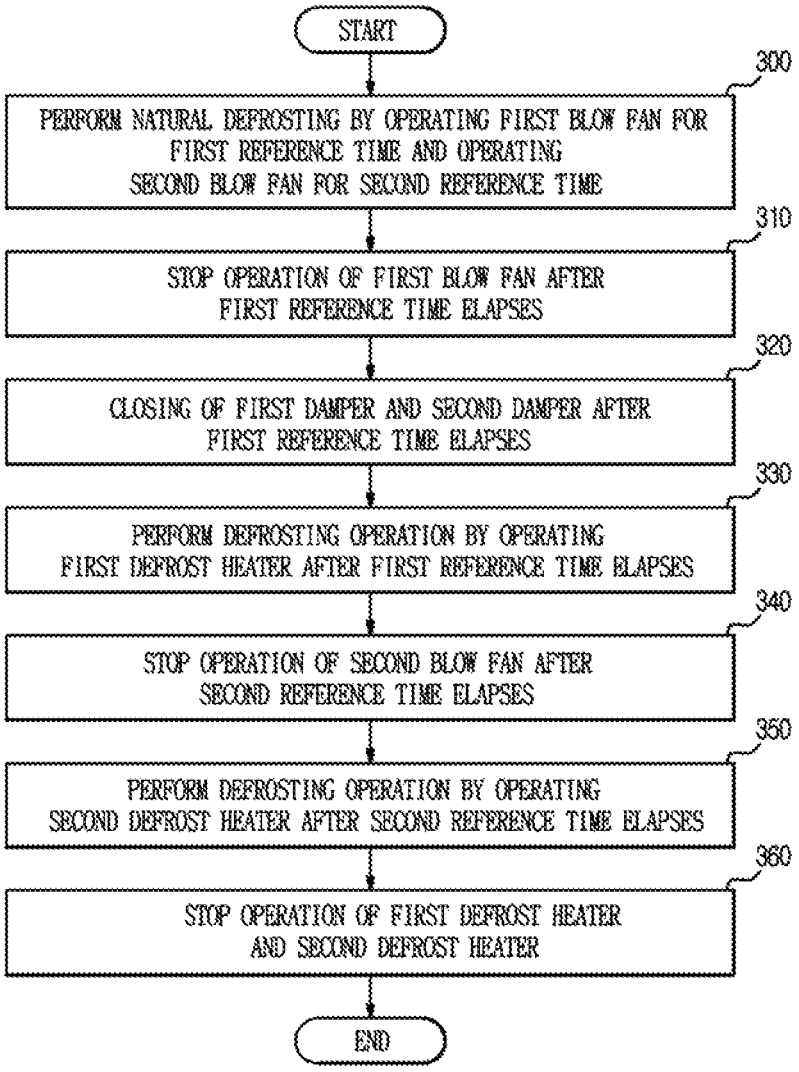
Figure 13:
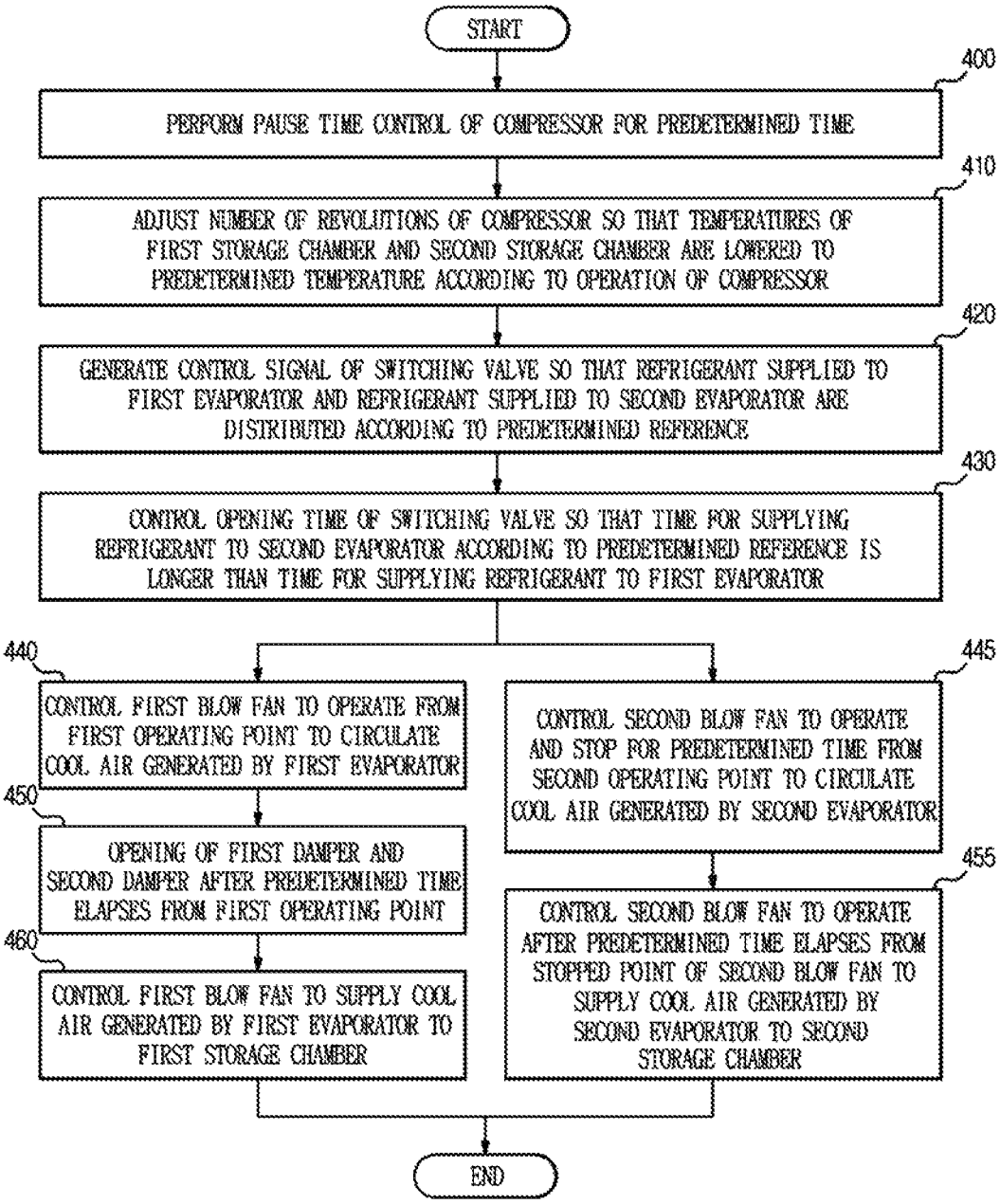

FIG. 4 is a block diagram illustrating the refrigerator according to an embodiment of the present disclosure. FIG. 5 is a control graph of a cooling section before a defrosting operation of the refrigerator according to an embodiment of the present disclosure, FIG. 6 is a control graph of a defrosting section of the refrigerator according to an embodiment of the present disclosure, and FIG. 7 is a control graph of the cooling section after the defrosting operation of the refrigerator according to an embodiment of the present disclosure. FIG. 8 is a view illustrating a flow of cool air when a first damper and a second damper are closed according to an embodiment of the present disclosure, and FIG. 9 is a view illustrating the flow of cool air when the first damper and the second damper are opened according to an embodiment of the present disclosure. FIG. 10 is a control graph of the entirety of a control section of the refrigerator according to an embodiment of the present disclosure. FIGS. 11 to 13 are flowcharts illustrating a method for controlling the refrigerator according to an embodiment of the present disclosure.

As shown in FIG. 4, the refrigerator 1 may further include, in addition to the components shown in FIGS. 1 to 3, a storage chamber temperature sensor 90 configured to measure the temperature of the storage chamber 20, a controller 100 configured to control the cooling device 50 according to an output of the storage chamber temperature sensor 90, and to control components included in the refrigerator 1, and a memory 110 configured to store data related to the operation of the refrigerator 1.

The storage chamber temperature sensor 90 may include a first storage chamber temperature sensor 91 for measuring the temperature of the first storage chamber 20*a*, a second storage chamber temperature sensor 92 for measuring the temperature of the second storage chamber 20*b*, and a third storage chamber temperature sensor 93 for measuring the temperature of the third storage chamber 20*c*.

The first storage chamber temperature sensor 91 may be provided in the first storage chamber 20*a* to measure the temperature of the first storage chamber 20*a* and to output an electrical signal corresponding to the temperature of the first storage chamber 20*a* to the controller 100. For example, the first storage chamber temperature sensor 91 may be a thermistor whose electrical resistance value changes according to the temperature.

The second storage chamber temperature sensor 92 may be provided in the second storage chamber 20*b* to measure the temperature of the second storage chamber 20*b* and to output an electrical signal corresponding to the temperature of the second storage chamber 20*b* to the controller 100. For example, the second storage chamber temperature sensor 92 may be the thermistor whose electrical resistance value changes according to the temperature.

The third storage chamber temperature sensor 93 may be provided in the third storage chamber 20*c* to measure the temperature of the third storage chamber 20*c* and to output an electrical signal corresponding to the temperature of the third storage chamber 20*c* to the controller 100. For example, the third storage chamber temperature sensor 93 may be the thermistor whose electrical resistance value changes according to the temperature.

The memory 110 may store control programs and control data for controlling operations of the refrigerator 1, and various application programs and application data for performing various functions according to the user's inputs. Also, the memory 110 may temporarily store an output of the storage chamber temperature sensor 90 and an output of the controller 100.

The memory 110 may include volatile memory, such as Static-Random Access Memory (S-RAM) and Dynamic-Random Access Memory (D-RAM), for temporarily storing data. Also, the memory 110 may include non-volatile memory, such as Read Only Memory (ROM), Erasable Programmable Read Only Memory (EPROM), and Electrically Erasable Programmable Read Only Memory (EEPROM), for storing data for a long period of time.

The controller 100 may include various logic circuits and operation circuits, and process data according to a program provided from the memory 110, and generate a control signal according to the result of the processing.

For example, the controller 100 may process an output of the storage chamber temperature sensor 90, and generate a cooling control signal for controlling the compressor 51 and the switching valve 53 of the cooling device 50 in order to cool the storage chamber 20.

As such, the controller 100 may control the components included in the refrigerator 1 according to the temperature of the storage chamber 20 or the like.

Also, operations of the refrigerator 1, which will be described below, may be performed according to the control of the controller 100.

Referring to FIG. 5, prior to the defrosting operation of the refrigerator 1, the refrigerator 1 may perform a cooling control for supplying the cool air to the storage chamber 20 according to the control of the controller 100. The cooling control corresponds to a pre-cooling control for lowering the temperature of the storage chamber 20 in advance before the defrosting operation of the refrigerator 1 is performed.

When the defrosting operation of the refrigerator 1 is performed, defrosting heat generated by the first defrost heater 71 and the second defrost heater 72 enters the storage chamber 20 to prevent the temperature inside the storage chamber from rising above a set temperature. That is, even if the defrosting heat enters the storage chamber 20 by lowering the temperature of the storage chamber 20 before the defrosting operation of the refrigerator 1, the freshness of the food stored in the storage chamber 20 may be maintained by preventing the temperature of the storage chamber 20 from rising above the set temperature.

The controller 100 may control the compressor 51 to compress the refrigerant to a high pressure for the cooling control. That is, the controller 100 may adjust the number of revolutions of the compressor 51 to a predetermined number of revolutions so that the temperatures of the first and second storage chambers 20*a* and 20*b* are lowered to a predetermined temperature. At this time, the number of revolutions of the compressor 51 controlled by the controller 100 may vary depending on a set value or a stored data. That is, the controller 100 may adjust the number of revolutions of the compressor 51 based on the temperature of the storage chamber 20 detected by the storage chamber temperature sensor 90. Further, the number of rotations of the compressor 51 may be adjusted to the set value for maintaining an optimum temperature based on the optimum temperature for storing the food stored in the storage chamber 20.

Since the first storage chamber 20*a* is connected to the third storage chamber 20*c* through the third cool air duct 64, the controller 100 may determine the number of revolutions of the compressor 51 by comparing the temperatures of the respective storage chambers 20 detected by the first storage chamber temperature sensor 91, the second storage chamber temperature sensor 92, and the third storage chamber temperature sensor 93 with temperature data pre-stored in the memory 110.

The temperature data pre-stored in the memory 110 may be stored in the storage chamber 20 at the lowest temperature to prevent the refrigerated food from freezing and the quality of the food being impaired.

The refrigerant compressed by the compressor 51 may be supplied to at least one of the first evaporator 56 and the second evaporator 57 by the switching valve 53. The controller 100 may generate the control signal for controlling the switching valve 53 so that the refrigerant supplied to at least one of the first evaporator 56 and the second evaporator 57 is distributed according to a predetermined reference.

The predetermined reference for the switching valve 53 to distribute the refrigerant may be stored in the memory 110. The reference may vary depending on the set temperature for lowering the temperature of each of the storage chambers 20 or the size of each of the storage chambers 20. That is, the controller 100 may control the switching valve 53 to distribute the refrigerant corresponding to the predetermined optimum temperature of the storage chamber 20, and adjust the refrigerant distribution ratio of the switching valve 53 by comparing the temperature of the storage chamber 20 detected by the storage chamber temperature sensor 90 with the predetermined optimum temperature.

In the embodiment of the disclosed disclosure, as shown in FIG. 3, the first storage chamber 20*a* is connected to the third storage chamber 20*c* through the third coolant duct 64 and the space to be cooled by the cool air generated by the first evaporator 56 is larger than the space of the second storage chamber 20*b* where the cool air generated by the second evaporator 57 is to be cooled. Accordingly, the controller 100 may adjust the refrigerant distribution ratio of the switching valve 53 such that the temperature of the first storage chamber 20*a* connected to the third storage chamber 20*c* becomes lower than the temperature of the second storage chamber 20*b*.

Particularly, the controller 100 may generate the control signal for controlling the opening time of the switching valve 53 so that the time for supplying the refrigerant to the first evaporator according to the predetermined reference is longer than the time for supplying the refrigerant to the second evaporator.

As shown in FIG. 5, the controller 100 may control the switching valve 53 such that an opening time $t_u$ for supplying the refrigerant to the first evaporator 56 is longer than an opening time $t_1$ for supplying the refrigerant to the second evaporator 57. At this time, the refrigerant supply distribution ratio to the first evaporator 56 and the second evaporator 57, that is, $t_u$:$t_1$ may be changed according to the embodiment.

Although not shown in FIG. 5, the controller 100 may control the switching valve 53 such that the opening degree for supplying the refrigerant to the first evaporator 56 is larger than the opening degree for supplying the refrigerant to the second evaporator 57.

The switching valve 53 may supply the refrigerant to the first evaporator 56 and the second evaporator 57 according to the control of the controller 100 and the first evaporator 56 and the second evaporator 57 may generate the cool air.

Referring to FIG. 5, the first damper 81 and the second damper 82 may be opened in a cooling control section in which cool air is supplied to the storage chamber 20 according to the control of the controller 100 prior to the defrosting operation.

The cool air generated by the first evaporator 56 can be supplied to the first storage chamber 20*a* through the first damper 81 by the operation of the first blow fan 56*b*, and the cool air passing through the third cool air duct 64 by the operation of the circulation fan 63 may be supplied to the third storage chamber 20*c* through the second damper 82.

Likewise, the cool air generated by the second evaporator 57 may be supplied to the second storage chamber 20*b* by the operation of the second blow fan 57*b*.

That is, as described in FIG. 5, the controller 100 may generate the control signal so that the switching valve 53 is distributed in accordance with the predetermined reference to the refrigerant supplied to the first evaporator 56 and the second evaporator 57, and the temperatures of the first storage chamber 20*a* and the second storage chamber 20*b* connected to the third storage chamber 20*c* may be lowered to the predetermined temperature.

Referring to FIG. 6, the refrigerator 1 may perform the defrosting operation for controlling the freezing or the frost generated in the evaporator, the outlet, etc., according to the control of the controller 100.

As described above, when the first defrost heater 71 is operated, the air heated by the first defrost heater 71 may be raised by natural convection and may be guided to the first damper 81 or the outlet (not shown) through the first cool air duct 56*a*. Since the air convection in the first cool air duct 56*a* maintains a high temperature, the freezing may be stopped or the frost generated in the first evaporator 56, the first damper 81, or the outlet (not shown) may be removed by the air having the high temperature, and the cool air may be smoothly supplied to the first storage chamber 20*a*.

When the second defrost heater 72 is operated, the air heated by the second defrost heater 72 may be raised by natural convection and may be guided to the outlet (not shown) through the second cool air duct 57*a*. Since the air convection in the second cool air duct 57*a* maintains the high temperature, the freezing may be stopped or the frost generated in the second evaporator 57 or the outlet (not shown) may be removed by the air having the high temperature, and the cool air may be smoothly supplied to the second storage chamber 20*b*.

The first damper 81 and the second damper 82 may be closed according to the control of the controller 100 to prevent the high temperature air heated by the defrost heater from flowing into the storage chamber 20 while the defrosting operation is being performed.

Power consumption [W] of such defrost heater may be different according to the specification, and the defrosting capability may also differ depending on the difference of the power consumption. Generally, in the case of the storage chamber 20 for performing the freezing operation in each of the storage chambers 20 of the refrigerator 1, the freezing or frost may occur more frequently in the configuration of the refrigerator 1 than in the case of the storage chamber 20 for performing only the refrigeration operation.

Therefore, the power consumption of the defrost heater provided in the lower part of the evaporator provided in the rear of the storage chamber for performing the freezing operation is larger than the power consumption of the defrost heater provided in the lower part of the evaporator provided in the rear of the storage chamber for performing only the refrigeration operation, and also a large defrosting capability.

In the refrigerator according to the embodiment of the present disclosure, the first storage chamber 20*a* and the third storage chamber 20*c* may perform the refrigeration operation and the second storage chamber 20*b* may perform the refrigeration operation and the freezing operation, for example. However, the cooling operation mode of each of the storage chambers 20 is not limited, and various design changes are possible.

Since the second storage chamber 20*b* also performs the freezing operation, freezing or frost may occur more frequently therein than in the first and third storage chambers 20*a* and 20*c*, which perform only the refrigeration operation. Therefore, the power consumption of the second defrost heater 72 provided at the lower part of the second evaporator 57 provided at the rear of the second storage chamber 20*b* may be larger than the power consumption of the first defrost heater 71 provided at the lower part of the first evaporator 56 provided at the rear of the first storage chamber 20*a*.

The first defrost heater 71 and the second defrost heater 72 may be operated for defrosting and may supply heat for stopping the freezing or removing the frost. The first defrost heater 71 and the second defrost heater 72 may stop the operation when the temperature reaches a defrosting completion point at which the freezing is stopped or the frost is removed according to the predetermined reference.

At this time, since the power consumption of the second defrost heater 72 is larger than the power consumption of the first defrost heater 71 and the defrosting capability is large, the defrosting operation by the second defrost heater 72 may reach the defrosting completion point first than the defrosting operation by the first defrost heater 71. Therefore, the second defrost heater 72 may be stopped before the first defrost heater 71 is started.

If the operation of the first defrost heater 71 is not stopped even if the operation of the second defrost heater 72 is stopped, the refrigeration operation after the defrosting of the refrigerator 1 is not started since the defrosting operation is not completed. Therefore, the air temperature of the second cool air duct 57*a* and the second storage chamber 20*b* provided with the second defrost heater 72 in which the operation is stopped may be increased over time.

In order to prevent the defrosting operation by the second defrost heater 72 having a larger power consumption to be completed first and the temperature on the second storage chamber 20*b* side to rise accordingly, it is necessary to delay the defrosting operation start point of the second defrost heater 72 by a predetermined time.

Referring to FIG. 6, the defrosting operation stage of the refrigerator 1 may include a natural defrosting stage in which the blow fan is operated to stop the freezing or remove the frost before the defrost heater is operated to perform the defrosting.

The controller 100 may control the first blow fan 56*b* and the second blow fan 57*b* for the natural defrosting. That is, as shown in FIG. 6, the controller 100 may operate the first blow fan 56*b* for a first reference time t1 to perform the natural defrosting operation on the first storage chamber 20*a*. At this time, data for the first reference time t1 may be preset and stored in the memory 110.

The controller 100 may generate the control signal for operating the first defrost heater 71 after the first reference time t1 when the first blow fan 56*b* is operated. The first defrost heater 71 may operate based on the control signal generated by the controller 100 from a point $t_a$ when the first blow fan 56*b* stops the operation to remove the frost on the surface of the first evaporator 56.

The controller 100 may control the first damper 81 and the second damper 82 so that the first blow fan 56*b* stops the operation and to be closed from the point when the first defrost heater 71 starts to operate.

As shown in FIG. 6, the controller 100 may operate the second blow fan 57*b* for a second reference time t2 to perform the natural defrosting for the second storage chamber 20*b*.

The controller 100 may generate the control signal for operating the second defrost heater 72 after the second reference time t2 when the second blow fan 57*b* is operated. The second defrost heater 72 may operate based on the control signal generated by the controller 100 from a point $t_b$ at when the second blow fan 57*b* stops the operation to remove the frost on the surface of the second evaporator 57.

At this time, the data for the second reference time t2 may be preset and stored in the memory 110. The second reference time t2 may be longer than the first reference time t1 by a predetermined time $t_x$.

That is, the controller 100 may delay the operating point $t_b$ of the second defrost heater 72 by the predetermined time $t_x$ than the operating point $t_a$ of the first defrost heater 71, the defrosting operation by the second defrost heater 72 is completed first and the temperature of the second storage chamber 20*b* may be prevented from rising.

As shown in FIG. 6, during the defrosting operation by the first defrost heater 71 and the second defrost heater 72, the operation of the compressor 51 may be stopped and the switching valve 53 may be closed according to the control of the controller 100.

In addition, the controller 100 may transmit the control signal for causing the operation of the first defrost heater 71 and the second defrost heater 72 to be stopped at the same time, various embodiments may exits depending on the change in the predetermined defrosting completion point.

Referring to FIG. 7, after the completion of the defrosting operation of the refrigerator 1, the refrigerator 1 may perform the cooling control for supplying the cool air to the storage chamber 20 according to the control of the controller 100. This is to lower the temperature of the storage chamber 20 by stopping the cooling operation during the defrosting operation, in contrast to the pre-cooling control shown in FIG. 5.

First, the controller 100 may control the compressor 51 to compress the refrigerant to a high pressure. That is, the controller 100 may adjust the number of revolutions of the compressor 51 to the predetermined number of revolutions so that the temperatures of the first and second storage chambers 20*a* and 20*b* are lowered to the predetermined temperature. In this case, the number of revolutions of the compressor 51 controlled by the controller 100 may vary depending on the set value or the stored data.

The compressor 51 may be stopped even if the defrosting operation is completed for the predetermined time before the controller 100 starts the operation of controlling the compressor 51 to compress the refrigerant. Control of the compressor 51 to stop for the predetermined time may be referred to as a pause time control, which is the control for stability of the operation of the compressor 51 corresponding to the increased heat load of the storage chamber 20. The time required for the pause time control may vary depending on the set value or the stored data, and the temperature rise of the storage chamber 20 may be minimized as the pause time is minimized.

The refrigerant compressed by the compressor 51 may be supplied to at least one of the first evaporator 56 and the second evaporator 57 by the switching valve 53. The controller 100 may generate the control signal to control the switching valve 53 such that the refrigerant supplied to at least one of the first evaporator 56 and the second evaporator 57 is distributed according to the predetermined reference.

The predetermined reference for the switching valve 53 to distribute the refrigerant may be stored in the memory 110. The reference may vary depending on the degree to which the temperature of each of the storage chambers 20 rises during the defrosting operation. That is, the controller 100 may control the switching valve 53 to distribute the refrigerant corresponding to the predetermined optimum temperature of the storage chamber 20, and adjust the refrigerant distribution ratio of the switching valve 53 by comparing the temperature of the storage chamber 20 detected by the storage chamber temperature sensor 90 with the predetermined optimum temperature.

In the embodiment of the disclosed disclosure, as described above, since the power consumption and the defrosting capability of the second defrost heater 72 are larger than the power consumption and the defrosting capability of the first defrost heater 71, the temperature of the second storage chamber 20*b* may be higher than the temperatures of the first storage chamber 20*a* and the third storage chamber 20*c* when the defrosting operation is completed.

Accordingly, the controller 100 may adjust the refrigerant distribution ratio of the switching valve 53 such that the amount of cool air supplied to the second storage chamber 20*b* is larger than the amount of cool air supplied to the first storage chamber 20*a*.

Particularly, the controller 100 may generate the control signal to control the opening time of the switching valve 53 such that the time for supplying the refrigerant to the second evaporator 57 is longer than the time for supplying the refrigerant to the first evaporator 56 according to the predetermined reference.

As shown in FIG. 7, the controller 100 may control the switching valve 53 such that the opening time $t_1$ for supplying the refrigerant to the second evaporator 57 is longer than the opening time $t_u$ for supplying the refrigerant to the first evaporator 56. At this time, the refrigerant supply distribution ratio to the second evaporator 57 and the first evaporator 56 may be changed according to the embodiment.

Although not shown in FIG. 7, the controller 100 may control the switching valve 53 such that the opening degree for supplying the refrigerant to the second evaporator 57 is larger than the opening degree for supplying the refrigerant to the first evaporator 56.

The switching valve 53 may supply the refrigerant to the first evaporator 56 and the second evaporator 57 according to the control of the controller 100 and the first evaporator 56 and the second evaporator 57 may generate the cool air.

Referring to FIG. 7, in an initial stage of the cooling operation after the defrosting operation, the evaporator and the blow fan may not be operated for the predetermined time so that the defrosting heat inside the evaporator does not enter the storage chamber 20, and the refrigerant may be supplied to the evaporator by operating the compressor 51 and the switching valve 53.

That is, when the blow fan does not operate, even if the refrigerant is supplied to the stationary evaporator by the switching valve 53 and the evaporator is cooled, or the cool air is generated by the evaporator, the cool air may stay in the lower part of the duct and relatively hot air may stay in the upper part of the duct. In this case, when the damper is opened while the blow fan is directly operated, the hot air staying in the upper part may flow into the storage chamber 20. Therefore, it is necessary to mix the cool air and the hot air inside the duct by operating the blow fan before opening the damper.

Referring to the embodiment of the present disclosure, when the first blow fan 56*b* does not operate, the cool air by the first evaporator 56 may stay in the lower part of the first cool air duct 56*a*, and the relatively hot air may stay in the upper part of the first cool air duct 56*a*.

Therefore, the controller 100 may control the first damper 81 and the second damper 82 to be opened after the first blow fan 56*b* operates for the predetermined time without opening the first damper 81 and the second damper 82 as soon as the operation of the first blow fan 56*b* is started.

Particularly, referring to FIG. 7, the controller 100 may control the first blow fan 56*b* to be operated from a first operating point $t_c$, and may cause the cool air generated by the first evaporator 56 to circulate in the first cool air duct 56*a* for a predetermined time $t_y$ as shown in FIG. 8. That is, the controller 100 may mix the cool air generated by the first evaporator 56 so that the cool air located at the lower end of the first cool air duct 56*a* can move to the upper end.

In this case, the controller 100 may control the first damper 81 and the second damper 82 to be closed before the predetermined time $t_y$ elapses from the first operating point $t_c$ of the first blow fan 56*b*.

The controller 100 may control the first damper 81 and the second damper 82 to be opened after the predetermined time $t_y$ elapses from the first operating point $t_c$ of the first blow fan 56*b*. When the first damper 81 and the second damper 82 are opened, the controller 100 may control the first blow fan 56*b* so that the cool air generated by the first evaporator 56 is supplied to the first storage chamber 20*a* as shown in FIG. 9. The controller 100 may control the circulation fan 63 so that the cool air generated by the first evaporator 56 is supplied to the third storage chamber 20*c* through the third cool air duct 64 as shown in FIG. 9.

At this time, the predetermined time $t_y$ in which only the first blow fan 56*b* is operated while the first damper 81 and the second damper 82 are closed may vary according to the set value or the stored data.

Likewise, when the second blow fan 57*b* does not operate, the cool air by the second evaporator 57 may stay in the lower part of the second cool air duct 57*a*, and the relatively hot air may stay in the upper part of the second cool air duct 57*a*.

Therefore, the controller 100 may control the second blow fan 57*b* to be operated from a second operating point td for a predetermined time $t_z$, and may cause the cool air generated by the second evaporator 57 to circulate in the second cool air duct 57*a* for the predetermined time $t_z$ as shown in FIG. 8.

That is, the controller 100 may mix the cool air generated by the second evaporator 57 so that the cool air located at the lower end of the second cool air duct 57*a* can move to the upper end.

In addition, the controller 100 may control the second blow fan 57*b* for the predetermined time $t_z$ to circulate the cool air. The controller 100 may control the second blow fan 57*b* to operate at a point $t_g$ at which a predetermined time $t_f$ elapses from a stopped point $t_e$ so that the cool air generated by the second evaporator 57 is supplied to the second storage chamber 20*b*.

In this way, the controller 100 may delay the opening time of the first damper 81 and the second damper 82, and may control the first blow fan 56*b* and the second blow fan 57*b* so that the cool air can be entered into the first storage chamber 20*a*, the second storage chamber 20*b* and the third storage chamber 20*c*, by circulating the cool air generated in the first evaporator 56 and the second evaporator 57 in the first cool air duct 56*a* and the second cool air duct 57*a*.

Referring to FIG. 11, the controller 100 may adjust the number of revolutions of the compressor 51 so that the temperatures of the first and second storage chambers 20*a* and 20*b* are lowered to the predetermined temperature (200). That is, the controller 100 may adjust the number of revolutions of the compressor 51 based on the temperature of the storage chamber 20 detected by the storage chamber temperature sensor 90. Further, the number of rotations of the compressor 51 may be adjusted to the set value for maintaining the optimum temperature based on the optimum temperature for storing the food stored in the storage chamber 20.

Since the first storage chamber 20*a* is connected to the third storage chamber 20*c* through the third cool air duct 64, the controller 100 may compare the temperature of each of the storage chambers 20 detected by the first storage chamber temperature sensor 91, the second storage chamber temperature sensor 92, and the third storage chamber temperature sensor 93 with the temperature data pre-stored in the memory 110, and determine the number of revolutions of the compressor 51. The temperature data pre-stored in the memory 110 may be stored in the storage chamber 20 at a minimum temperature to prevent the refrigerated food from freezing and not damaging the quality of the food.

The controller 100 may generate the control signal to control the switching valve 53 such that the refrigerant supplied to the first evaporator 56 and the refrigerant supplied to the second evaporator 57 are distributed according to the predetermined reference (210). In other words, the controller 100 may generate the control signal for controlling the opening time of the switching valve 53 so that the time for supplying the refrigerant to the first evaporator 56 according to the predetermined reference is longer than the time for supplying the refrigerant to the second evaporator 57 (220).

The controller 100 may perform the pre-cooling control to lower the temperatures of the first and second storage chambers 20*a* and 20*b* based on the generated control signal of the switching valve 53 (230), and may lower the temperatures of the first and second storage chambers 20*a* and 20*b* connected to the third storage chamber 20*c* to the predetermined temperature.

Referring to FIG. 12, the controller 100 may perform the natural defrosting on the first storage chamber 20*a* and the second storage chamber 20*b* by operating the first blow fan 56*b* for the first reference time t1 and the second blow fan 57*b* for the second reference time t2 (300).

That is, the defrosting operation stage of the refrigerator 1 may include the natural defrosting stage of stopping the freezing or removing the frost by operating the blow fan before operating the defrost heater and performing the defrosting.

The controller 100 may control the first blow fan 56*b* to stop the operation after the first reference time t1 elapses (310), and the first damper 81 and the second damper 82 may be closed after the elapse of the reference time $t_1$ (320). Also, the first defrost heater 71 may operate after the elapse of the first reference time t1 to perform the defrosting operation (330).

In other words, the first defrost heater 71 may operate from the point $t_a$ at which the first blow fan 56*b* stops the operation based on the control signal generated by the controller 100 to remove the frost on the surface of the first evaporator 56.

The controller 100 may control the second blow fan 57*b* to stop the operation after the second reference time t2 elapses (340), and the second defrost heater 72 may operate after the elapse of the second reference time t2 to perform the defrosting operation (350).

In other words, the second defrost heater 72 may operate from the point $t_b$ at which the second blow fan 57*b* stops the operation based on the control signal generated by the controller 100 to remove the frost on the surface of the second evaporator 57.

In addition, the controller 100 may transmit the control signal to stop the operation of the first defrost heater 71 and the second defrost heater 72 simultaneously (360).

As described above, the controller 100 may delay the operating point $t_b$ of the second defrost heater 72 by the predetermined time $t_x$ than the operating point $t_a$ of the first defrost heater 71, and the defrosting operation by the second defrost heater 72 is completed first and the temperature of the second storage chamber 20*b* may be prevented from rising.

Referring to FIG. 13, after the completion of the defrosting operation of the refrigerator 1, the refrigerator 1 may perform the cooling control for supplying the cool air to the storage chamber 20 according to the control of the controller 100. First, the controller 100 may perform the pause time control to cause the compressor 51 to stop for the predetermined time (400).

The controller 100 may control the compressor 51 to compress the refrigerant to a high pressure and adjust the number of revolutions of the compressor 51 to the predetermined number of revolutions so that the temperatures of the first and second storage chambers 20*a* and 20*b* are lowered to the predetermined temperature (410).

The controller 100 may also generate the control signal to control the switching valve 53 such that the refrigerant supplied to at least one of the first evaporator 56 and the second evaporator 57 is distributed according to the predetermined reference (420). That is, the controller 100 may generate the control signal for controlling the opening time of the switching valve 53 so that the time for supplying the refrigerant to the second evaporator 57 according to the predetermined reference is longer than the time for supplying the refrigerant to the first evaporator 56 (430).

The controller 100 may control the first blow fan 56*b* to be operated from the first operating point $t_c$, and may cause the cool air generated by the first evaporator 56 to circulate in the first cool air duct 56*a* for the predetermined time $t_y$ (440).

The controller 100 may also control the first damper 81 and the second damper 82 to be opened after the predetermined time $t_y$ elapses from the first operating point $t_c$ of the first blow fan 56*b* (450). When the first damper 81 and the second damper 82 are opened, the controller 100 may control the first blow fan 56*b* so that the cool air generated by the first evaporator 56 is supplied to the first storage chamber 20*a* (460).

The controller 100 may control the second blow fan 57*b* to be operated from a second operating point td for the predetermined time $t_z$, and may cause the cool air generated by the second evaporator 57 to circulate in the second cool air duct 57*a* for the predetermined time $t_z$ (445). That is, the controller 100 may mix the cool air generated by the second evaporator 57 so that the cool air located at the lower end of the second cool air duct 57*a* can move to the upper end.

In addition, the controller 100 may control the second blow fan 57*b* for the predetermined time $t_z$ to circulate the cool air. The controller 100 may control the second blow fan 57*b* to operate at the point $t_g$ at which the predetermined time $t_f$ elapses from the stopped point $t_e$ so that the cool air generated by the second evaporator 57 is supplied to the second storage chamber 20*b* (455).

As described above, the refrigerator 1 according to an embodiment of the present disclosure can prevent the temperature of the storage chamber 20 from increasing due to the defrosting heat generated in the defrosting process, and perform an efficient refrigeration and freezing operation.

As is apparent from the above description, the refrigerator and the method for controlling the same according to the embodiments of the present disclosure can prevent the quality and taste of the food stored in the storage chamber from being changed due to the temperature increase of the storage chamber by the defrosting heat generated during the defrosting process.

In addition, the defrosting heat can be prevented from entering the storage chamber by changing the control algorithm for the existing configuration without adding a separate configuration of the refrigerator.

Meanwhile, the embodiments of the present disclosure may be implemented in the form of recording media for storing instructions to be carried out by a computer. The instructions may be stored in the form of program codes, and when executed by a processor, may generate program modules to perform operations in the embodiments of the present disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The exemplary embodiments of the present disclosure have thus far been described with reference to the accompanying drawings. It will be obvious to people of ordinary skill in the art that the present disclosure may be practiced in other forms than the exemplary embodiments as described above without changing the technical idea or essential features of the present disclosure. The above exemplary embodiments are only by way of example, and should not be interpreted in a limited sense.

The invention claimed is:

1. A refrigerator comprising:

a main body;

a first storage chamber and a second storage chamber provided in the main body;

a first evaporator provided in the first storage chamber, configured to generate cool air;

a second evaporator provided in the second storage chamber, configured to generate the cool air;

a switching valve configured to supply a refrigerant to at least one of the first evaporator or the second evaporator; and a controller configured to, perform a pre-cooling operation by generating a control signal for controlling the switching valve so that the refrigerant supplied to at least one of the first evaporator or the second evaporator is distributed according to a predetermined reference based on a size of the first storage chamber and the second storage chamber, and lowering the temperature of the first storage chamber and the second storage chamber to a predetermined temperature based on the generated control signal, wherein the pre-cooling operation is performed prior to a defrost operation.

2. The refrigerator according to claim 1, further comprising:

a compressor configured to compress the refrigerant to a high pressure, wherein the controller is configured to adjust the number of revolutions of the compressor to a predetermined number of revolutions so that the temperature of the first storage chamber and the second storage chamber are lowered to the predetermined temperature.

3. The refrigerator according to claim 1, wherein the controller is configured to generate the control signal for controlling an opening time of the switching valve so that the time for supplying the refrigerant to the first evaporator is longer than the time for supplying the refrigerant to the second evaporator according to the predetermined reference.

4. The refrigerator according to claim 1, further comprising:

a first blow fan configured to supply the cool air generated by the first evaporator to the first storage chamber;

a second blow fan configured to supply the cool air generated by the second evaporator to the second storage chamber;

a first defrost heater provided at a lower part of the first evaporator; and a second defrost heater provided at a lower part of the second evaporator;

wherein the controller is configured to operate the first blow fan for a first reference time and generate a control signal for operating the first defrost heater after the first reference time elapses to remove frost on the surface of the first evaporator, and operate the second blow fan for a second reference time and generate the control signal for operating the second defrost heater after the second reference time elapses to remove the frost on the surface of the second evaporator.

5. The refrigerator according to claim 4, wherein the second reference time is longer than the first reference time by a predetermined time, and an operating point of the second defrost heater is delayed by the predetermined time from an operating point of the first defrost heater.

6. The refrigerator according to claim 4, wherein the first blow fan is configured to stop an operation after the elapse of the first reference time, and the second blow fan is configured to stop the operation after the elapse of the second reference time.

7. The refrigerator according to claim 4, wherein the controller is configured to transmit the control signal for controlling the operations of the first defrost heater and the second defrost heater to be stopped at the same time.

8. The refrigerator according to claim 1, further comprising:

a third storage chamber provided between the first storage chamber and the second storage chamber;

a first blow fan configured to supply the cool air generated by the first evaporator to the first storage chamber; and a second blow fan configured to supply the cool air generated by the second evaporator to the second storage chamber;

wherein the controller is configured to control the first blow fan to operate from a first operating point to circulate the cool air generated by the first evaporator, and control the second blow fan to operate and stop for a predetermined time from a second operating point to circulate the cool air generated by the second evaporator.

9. The refrigerator according to claim 8, further comprising:

a first damper configured to allow the cool air generated by the first evaporator to flow into the first storage chamber; and a second damper configured to allow the cool air introduced into the first storage chamber to flow into the third storage chamber.

10. The refrigerator according to claim 9, wherein the controller is configured to control the first damper and the second damper to be closed before the predetermined time elapses from the first operating point and to be opened after the predetermined time elapses from the first operating point.

11. The refrigerator according to claim 10, wherein the controller is configured to control the first blow fan to supply the cool air generated by the first evaporator to the first storage chamber when the first damper and the second damper are opened.

12. The refrigerator according to claim 8, wherein the controller is configured to control the second blow fan to operate after the predetermined time elapses from a stopping point of the second blow fan so that the cool air generated by the second evaporator is supplied to the second storage chamber.

13. The refrigerator according to claim 8, wherein the controller is configured to generate a control signal for controlling the switching valve so that the refrigerant supplied to at least one of the first evaporator or the second evaporator is distributed according to a predetermined reference.

14. The refrigerator according to claim 13, wherein the controller is configured to generate the control signal for controlling an opening time of the switching valve so that the time for supplying the refrigerant to the second evaporator is longer than the time for supplying the refrigerant to the first evaporator according to the predetermined reference.

15. A method for controlling a refrigerator, comprising:

performing a pre-cooling operation by adjusting a number of revolutions of a compressor to a predetermined number of revolutions so that a temperature of a first storage chamber and a second storage chamber provided in a main body of the refrigerator body is lowered to a predetermined temperature;

generating a control signal for controlling a switching valve for distributing a refrigerant to be supplied to a first evaporator provided in the first storage chamber for generating cool air and a refrigerant to be supplied to a second evaporator provided in the second storage chamber for generating cool air, according to a predetermined reference which is based on a size of the first storage chamber and the second storage chamber; and lowering the temperature of the first storage chamber and the second storage chamber to the predetermined temperature based on the generated control signal, wherein the pre-cooling operation is performed prior to a defrost operation.

* * * * *